United States Patent [19]

Wagenseil et al.

[11] Patent Number: 4,617,853

[45] Date of Patent: Oct. 21, 1986

[54] AXIAL PISTON MACHINE OF THE SKEW AXIS TYPE WITH TWO INDEPENDENT WORKING STREAMS

[75] Inventors: Ludwig Wagenseil, Vöhringen; Walter Merkle, Nersingen, both of Fed. Rep. of Germany

[73] Assignee: Hydromatik, Elchingen, Fed. Rep. of Germany

[21] Appl. No.: 823,811

[22] Filed: Jan. 24, 1986

Related U.S. Application Data

[63] Continuation of Ser. No. 652,215, Sep. 19, 1984, abandoned.

[30] Foreign Application Priority Data

Sep. 19, 1983 [DE] Fed. Rep. of Germany ..... 3333812

[51] Int. Cl.[4] ..... F01B 13/04; F04B 1/30

[52] U.S. Cl. ..... 91/505; 92/12.2; 417/222

[58] Field of Search ..... 91/504–506; 417/222; 92/122

[56] References Cited

U.S. PATENT DOCUMENTS

| | | | |
|---|---|---|---|
| 2,990,784 | 7/1961 | Wahlmark | 91/499 |
| 3,233,555 | 2/1966 | Wahlmark | 91/506 |
| 3,943,828 | 3/1976 | Wagenseil . | |
| 3,961,563 | 6/1976 | Wagenseil | 91/506 |
| 4,449,444 | 5/1984 | Forester | 417/222 |
| 4,466,338 | 8/1984 | Stoelzer | 91/506 |

FOREIGN PATENT DOCUMENTS

| | | | |
|---|---|---|---|
| 44070 | 1/1982 | European Pat. Off. | 91/506 |
| 3134537 | 3/1983 | Fed. Rep. of Germany | 91/499 |
| 28709 | 3/1977 | Japan | 91/499 |
| 989128 | 1/1983 | U.S.S.R. | 417/269 |

*Primary Examiner*—William L. Freeh

*Attorney, Agent, or Firm*—Scully, Scott, Murphy & Presser

[57] ABSTRACT

An axial piston machine of the skew axis type with at least two independent working streams is described. In this at least two groups of working pistons are arranged in cylinder bores, each on a circle, whereby each group of working pistons delivers an independent working stream or provides a working stream with medium. Such an axial piston machine is constructed as a machine in which the delivery volume is continuously adjustable, and in which the angle of inclination of the cylinder drum can be changed by means of an adjusting mechanism. The entrainment of the cylinder drum only takes place through one of the groups of working pistons.

11 Claims, 6 Drawing Figures

AXIAL PISTON MACHINE OF THE SKEW AXIS TYPE WITH TWO INDEPENDENT WORKING STREAMS

TECHNICAL FIELD OF THE INVENTION

This application is a continuation of application Ser. No. 652,215, filed Sept. 19, 1984, now abandoned.

The invention relates to an axial piston machine of the skew axis having at least two independent working streams, in which at least two groups of working pistons are arranged, in cylinder bores of a cylinder drum, each group on a circle, namely a large diameter outer circle and a smaller diameter inner circle, wherein the working pistons are pivotably housed in a drive plate that is fixed to the drive shaft of the machine, and wherein the cylinder drum is rotatably driven by entrainment through the working pistons.

BRIEF DESCRIPTION OF THE PRIOR ART

An axial piston machine of this kind is known, for example, from German OLS No. 31 34 537. This is concerned with a so-called fixed unit, that is to say, the angle between the cylinder drum and the drive shaft is constant and not variable. Independent working streams of the medium delivered through the machine are produced by the two groups of working pistons arranged on different circles, the independent working streams being used to produce, by addition or subtraction of the delivery streams, a larger number of delivery volumes when the machine is used as a pump or a larger number of speeds when the machine is used as a motor. The several independent working streams are thus also used to render such a unit, which is inherently fixed, discontinuously variable, that is to say, variable in stages corresponding to the addition or subtraction of the delivery streams.

Axial piston machines with several groups of working pistons arranged on different circles, in which the working stream produced by each group of working pistons is continuously variable in volume simultaneously with or independently of the other working streams, are known, for example, from U.S. Pat. Nos. 1,714,148 and 2,520,632 and German patent specification No. 31 27 610. These are concerned throughout with axial piston machines of the so-called inclined plate type, in which the drive shaft and the cylinder drum have a common axis of rotation and the reciprocating movement of the working pistons in the cylinder bores of the cylinder drum is brought about by a plate inclined to the said axis of rotation. In such machines, particularly when they are used as pumps, no turning moment is transmitted through the working pistons to the cylinder drum, since the cylinder drum is not rotatably driven by the working pistons. The volumes delivered by the working streams can be varied in a simple manner by varying the inclination of the inclined plate to the axis of rotation. If, as can be seen from these known documents, separate inclined plates or inclined plate areas are allocated to the individual groups of working pistons on the respective circles, continuous independent adjustment of individual working streams is also made possible.

In the case of axial piston machines of the skew axis type with one working stream, i.e. one group of working pistons arranged on a circle, continuous variation of the delivery volume (or speed in the case of use as a motor) by variation of the angle of inclination between the drive shaft and the cylinder drum is known. This variation of the angle of inclination is brought about by an adjusting mechanism which partly engages with the housing containing the cylinder drum, which is mounted pivotably with regard to the part of the housing containing the drive shaft. The adjusting mechanism can also act directly on the face valve body, formed as pivoting slots within a solid housing. Since in each mode of operation of such skew axis machines the working pistons must transfer their frictional and accelerating moments to entrain the cylinder drum, and the working pistons must be so formed as to transmit these moments, it has not hitherto been economically possible to construct axial piston machines having a variable angle of inclination with several independent working streams. The number of masses that are moved does not permit high speeds. As can be seen from German OLS No. 31 27 610, in the case of axial piston machines of the skew axis construction several groups of working pistons on different circles have only been provided instead of the adjusting mechanism in order to produce a stagewise variation of the delivery streams, most suitably an addition to the delivery streams in pump operation or to the speed in the case of motor operation.

OBJECT OF THE INVENTION

The problem underlying the invention is to further develop a skew axis axial piston machine of the above-mentioned type having at least two independent working streams, so that even with higher speeds and changes in speed continuous variation of the delivery volumes of the working streams (use of pumps) or speed (use as motors) is possible under the control of the entrainment forces (moments) to be transmitted by the working pistons.

SUMMARY OF THE INVENTION

To solve this problem it is proposed, according to the invention, that in the case of an axial piston machine with skew axis connection tion of the above-mentioned type the axial piston machine is constructed as a machine in which the angle between the drive shaft and the cylinder drum, and thereby the delivery volume, is continuously adjustable, wherein an adjusting mechanism is provided engaging directly or indirectly with the face valve body, and that the entrainment of the cylinder drum is brought about by only one of the groups of working cylinders on one circle.

It has been found that the mass problems can also be controlled at high speeds if only one of the groups of working pistons arranged on one of the circles is used for the transfer of moment, and thereby rotational entrainment of the cylinder drum. Suitably the groups of non-entraining working pistons are spherical pistons with only one sealing zone extending into the cylinder bore as a seal. Such spherical pistons, which are in one piece and do not consist of a piston with a piston rod connected to it by a ball joint, are known per se.

In a first suitable embodiment of the invention the entrainment of the cylinder drum occurs only through the group of working pistons on the outer circle. Since the outer circle has a large diameter compared with other circles, and thus each working piston is at a greater radial distance from the central axis of rotation of the cylinder drum, in the case of this group of working pistons the forces of entrainment to be transmitted are small in respect of the turning moment to be transmitted. The working pistons can be correspondingly light construction and still transfer the entrainment forces required. It has also been found in the case of this construction that the behaviour as regards rotational oscillation of the cylinder drum when the cylinder drum is entrained only through the outer circle is particularly good.

In a second suitable embodiment of the invention the rotational entrainment of the cylinder drum occurs only through the group of working pistons on the inner circle. In the case of this construction the axial piston machine permits high speeds, since the working pistons on outer circles do not have to transmit any entrainment forces and can, therefore, be of light construction, so that the low masses produce only small centrifugal forces. Which of these two embodiments is particularly suitable depends on the field of use of the axial piston machine, and particularly on the speed level required.

In a suitable construction of both of the said embodiments of the invention the entraining working pistons are formed as one-piece pistons which, viewed from the drive plate into the cylinder bore, thicken conically and form an entrainment zone bearing on the cylinder bore, and in which the entrainment zone is adjoined by a ball zone extending as a seal into the cylinder bore, the ball having a diameter corresponding to the diameter of the cylinder bore.

Such one-piece pistons are known from German Auslegeschrift No. 23 58 870. They are particularly suitable for use in the context of the present invention since they are small and can be of light construction and permit larger angles of inclination between cylinder drum and drive shaft than do ordinary multi-part pistons, in which the entrainment forces are transmitted by the piston rods bearing on the cylinder bore or by bearing on a cylinder piston body which is connected to the piston rod by a ball joint.

BRIEF DESCRIPTION OF THE INVENTION

Examples of embodiments of the invention will now be described in more detail with reference to the accompanying drawings, which show:

FIG. 1: an axial piston machine according to the invention, diagrammatically and partially in section along the line I—I in FIG. 2, FIG. 2: a sectional view along the line II—II in FIG. 1, FIG. 3: An axial piston machine according to the invention, diagrammatically and partly in a section moved through 90° in relation to FIG. 1, FIG. 4: a sectional view along the line IV—IV in FIG. 3, FIG. 5: the first embodiment of the invention, in cut-out and section, FIG. 6: the second embodiment of the invention, in cut-out and section.

DETAILED DESCRIPTION OF THE INVENTION

Figure 1:
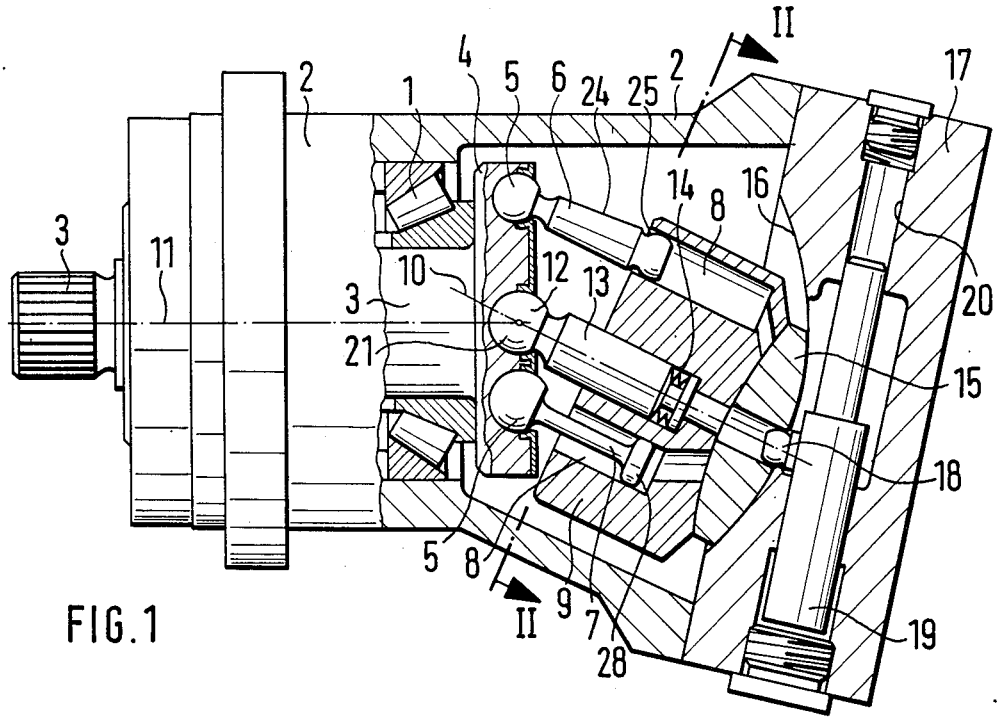
Figure 3:
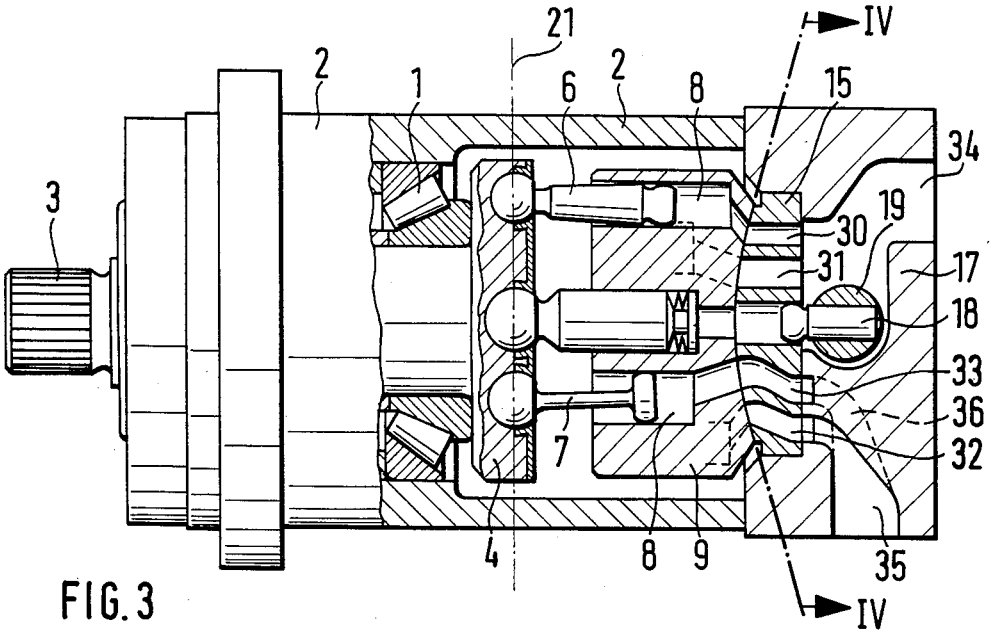
Figure 4:
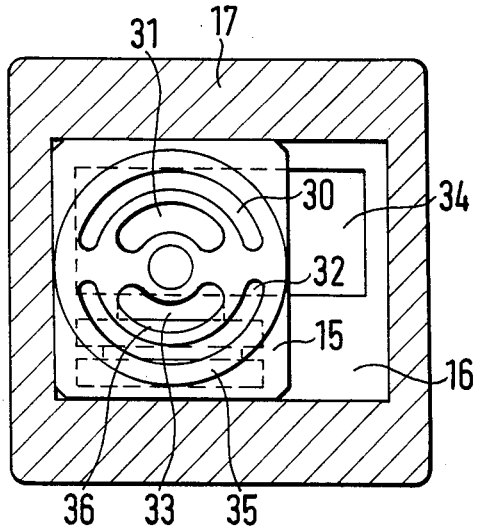

The axial piston machine shown in FIGS. 1 and 3 comprises a drive shaft 3 housed through a ball-bearing 1 in a housing 2 and carrying integrally a drive plate 4. Working pistons 6, 7 are connected to the drive plate 4 through ball joints 5. The working cylinders 6, 7 move in cylinder bores 8 of a cylinder drum 9. The cylinder drum 9 is set in rotation by the drive shaft 3 via the drive plate 4 and the working pistons 6. The stroke of the working pistons 6, 7 is directed towards the angle of inclination of the axis of rotation 10 of the cylinder drum to the axis of rotation 11 of the drive shaft 3. The cylinder drum 9 is centered by a center pin 13 mounted on the drive plate 4 by a ball 12 and is supported when the machine is under load under the effect of the pressure of the working medium, and in its unloaded state only under the pressure of the pressure springs 14 provided between the pin 13 and the cylinder drum 9 on a face valve body 15. The face valve body 15 is in turn supported on a cylindrical guideway 16 of the housing 17. To change the angle of inclination of the axis 10 of the cylinder drum 9 to the axis of the drive shaft 3, and thereby change the stroke volume of the working pistons 6, 7 in the cylinder bores 8, the face valve body 15 is engaged by an adjusting pin 18 fixed to an adjusting rod 19. The adjusting rod 19 for its part is moveably housed in the housing 17 in a bore 20. The adjusting rod 19 is engaged by an adjusting mechanism (not shown) by which the adjusting rod 19 can be displaced longitudinally so that the pin 18 moves the face valve body 15 in the cylindrical guide surface 16 while tilting the cylinder drum 9 around the tilting axis 21.

Figure 2:
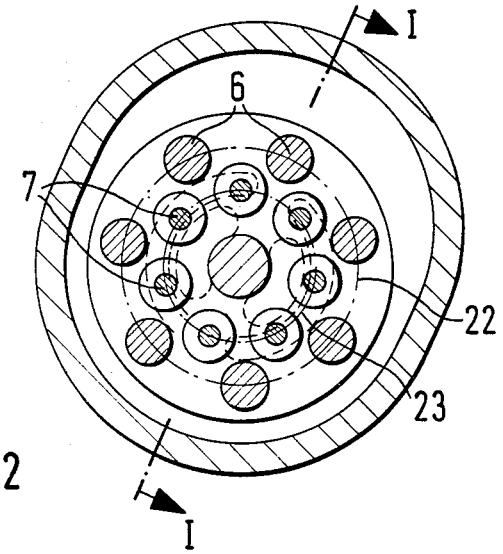
Figure 5:
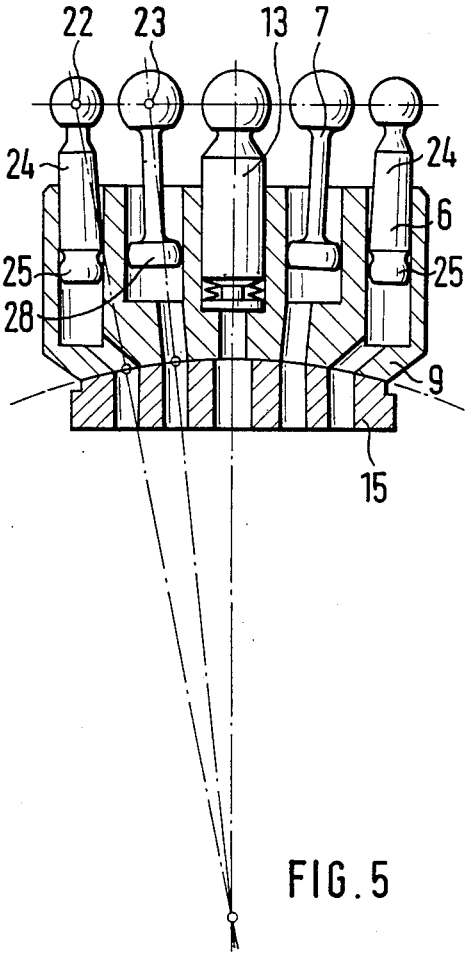
Figure 6:
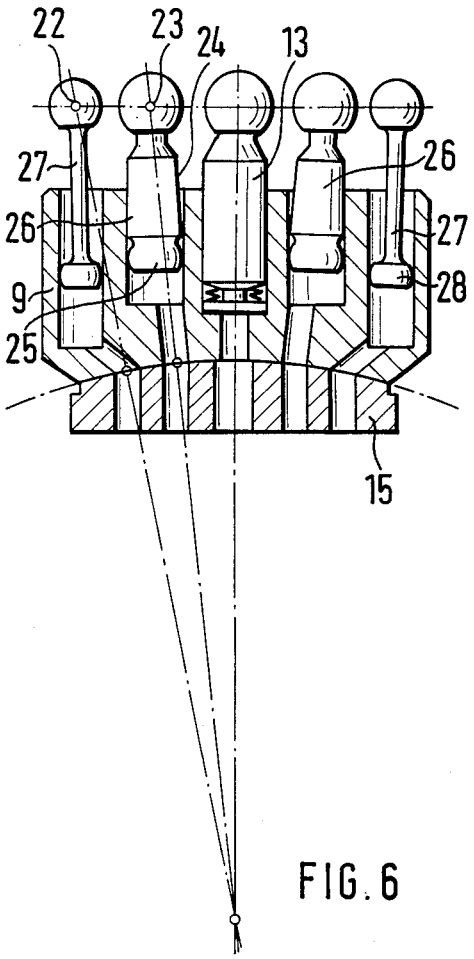

Two groups of working pistons 6 and 7 are provided which are arranged on different circles, an outer circle 22 and an inner circle 23. On each circle there is a group of seven pistons 6 and 7 respectively. In the embodiment shown in FIGS. 1 to 3 the working pistons 6 of the outer circle 22 are formed as rotationentraining working pistons, that is to say these pistons can transmit entrainment forces between the drive plate 4 and the cylinder drum 9. This occurs in the case of the working pistons 6, shown as one-piece pistons, through entrainment zones widening conically in the direction of the cylinder bores 8 and adjoined by the ball-zones 25 which perform the sealing function of the working pistons, as can be seen more clearly from FIG. 5. Such one-piece pistons 6 are known per se. The working pistons 7 on the inner circle according to FIGS. 1 to 3 and 5, which transmit no entraining forces, are formed as one-piece spherical pistons which merely have a spherical or ball zone 28 to perform the sealing function. Such spherical pistons are also known per se. In the case of the embodiment shown in FIG. 6 the rotation-entraining working pistons 26, that is to say those which transmit entrainment forces, are arranged on the inner circle 23 and the working pistons 27, which merely perform the sealing function, on the outer circle 22.

Within the face valve body 15 there are provided suction slots 30 and 31 and pressure slots 32 and 33 corresponding to each group of working pistons. In the embodiment shown, and using the axial piston machine as a pump, the two suction slots 30 and 31 are combined in a common suction duct 34, while the pressure slots 32, 33 each open into a separate pressure duct, so that separate, independent working circuits are formed on the pressure side. Obviously, contrary to the embodiment shown, the arrangement of the ducts 34, 35 and 36 within the housing 17 can also be symmetrical, so that there are also separate ducts on the suction side and completely independent working circuits are formed. Such axial piston machines can be operated both as motors and as pumps and provide open or closed working circuits. For pump operation such an axial piston machine can also be used for reverse operation, that is to say with positive and negative angles of inclination of the cylinder drum 9 from a neutral central position, so that the pressure and suction sides of the independent circuits can be interchanged.

What is claimed is:

1. A variable capacity axial piston machine of the skew axis type, comprising:

a housing;

a drive shaft extending into the housing and supported therein for rotation about a first axis;

a drive plate connected to the drive shaft for rotation therewith;

a cylinder drum supported in the housing for rotation about a second axis, and forming first and second groups of bores, a selected one of the groups of bores being arranged in an outer circle, the other core of the groups of bores being arranged in a concentric, inner circle;

a face valve body engaging the cylinder drum and having first control slot means to conduct a first fluid stream into and out from the first group of bores, and second control slot means to conduct a second fluid stream into and out from the second group of bores;

a first group of pistons pivotally connected to the drive plate for rotation therewith, and extending into the first group of bores;

a second group of pistons pivotally connected to the drive plate for rotation therewith, and extending into the second group of bores;

wherein the first group of pistons connect the cylinder drum to the drive plate for rotation therewith, and substantially all of the rotary force transmitted to the cylinder drum is transmitted thereto by only the first group of pistons; and adjusting means connected to the face valve body to move the face valve body and the cylinder drum to adjust the angle between the first and second axes over a continuously variable range of angles and to thereby adjust the capacity of the machine.

2. A machine according to claim 1 wherein:

each piston includes (i) a head portion pivotally connecting the piston to the drive plate, (ii) a bearing portion located in one of the bores and engaging the cylinder drum to seal said one bore, and (iii) a shaft portion extending between and connecting together the head and bearing portions;

the shafts of the pistons of the first group of pistons closely fit in the first group of bores to transmit substantially all the rotational forces transmitted from the drive plate to cylinder drum;

the shafts of the pistons of the second group of pistons are substantially thinner than the cross-sectional areas of the bores of the second group thereof to reduce the total mass of the machine.

3. A machine according to claim 1 wherein the selected group of bores is the first group thereof, and substantially all the rotary force transmitted to the cylinder drum is transmitted thereto by only the pistons extending into the bores arranged in the outer circle.

4. A machine according to claim 1 wherein the selected group of bores is the second group thereof, and substantially all the rotary force transmitted to the cylinder drum is transmitted thereto by only the pistons extending into the bores arranged in the inner circle.

5. A machine according to claim 4 wherein each piston of the first group of pistons includes:

a top portion pivotally connected to the drive plate;

a conically shaped driving portion extending downward from the top portion and into one of the bores of the first group thereof, and engaging the cylinder drum to rotate the drum with the drive shaft, the diameter of said driving portion increasing in the downward direction;

a ball shaped bearing portion located below and intergrally connected to the driving portion, and having a diameter substantially equal to the diameter of said one bore to seal said one bore.

6. A machine according to claim 5 wherein each piston of the second group of pistons extends into one of the bores of the second group thereof, includes a sealing portion engaging the cylinder drum to seal said one bore of the second group of bores, and contacts the cylinder drum only at the sealing portion.

7. A machine according to claim 3 wherein each piston of the first group of pistons includes:

a top portion pivotally connected to the drive plate;

a conically shaped driving portion extending downward from the top portion and into one of the bores of the first group reciprocate in the bores of the cylinder drum.

8. A machine according to claim 7 wherein each piston of the second group of pistons extends into one of the bores of the second group thereof, includes a sealing portion engaging the cylinder drum to seal said one bore of the second group of bores, and contacts the cylinder drum only at the sealing portion.

9. A variable capacity axial piston machine of the skew axis type, comprising:

a housing;

a drive shaft extending into the housing and supported therein for rotation about a first axis;

a drive plate connected to the drive shaft for rotation therewith;

a cylinder drum supported in the housing for rotation about a second axis, the first and second axes intersecting to form an angle of inclination therebetween;

the cylinder including first and second groups of bores, a selected one of the groups of bores being arranged in an outer circle, the other one of the groups of bores being arranged in a concentric, inner cirle;

means connecting the cylinder drum to the drive plate for pivotal movement to vary the angle between the first and second axes;

a face valve body engaging the cylinder drum and having first control slot means to conduct a first fluid stream into and out from the first group of bores, and second control slot means to conduct a second fluid stream into and out from the second group of bores;

a first group of pistons pivotally connected to the drive plate for rotation therewith, and extending into the first group of bores;

a second group of pistons pivotally connected to the drive plate for rotation therewith, and extending into the second group of bores;

wherein the first group of pistons connect the cylinder drum to the drive plate for rotation therewith, and substantially all of the rotary force transmitted to the cylinder drum is transmitted thereto by only the first group of pistons; and adjusting means connected to the face valve body to move the face valve body and the cylinder drum to vary the angle between the first and second axes over a continuously variable range of angles and to thereby adjust the capacity of the machine.

10. A machine according to claim 9 wherein the selected group of bores is the first group thereof, and substantially all the rotary force transmitted to the cylinder drum is transmitted thereto by only the pistons extending into the bores arranged in the outer circle.

11. A machine according to claim 9 wherein the selected group of bores is the second group thereof, and substantially all the rotary force transmitted to the cylinder drum is transmitted thereto by only the pistons extending into the bores arranged in the inner circle.

* * * * *